US006691760B1

(12) United States Patent
Randall, Jr. et al.

(10) Patent No.: US 6,691,760 B1
(45) Date of Patent: Feb. 17, 2004

(54) LIFT CORD TENSIONING DEVICE

(75) Inventors: Raymond E. Randall, Jr., New Hartford, NY (US); Vinny Grosso, Coxsackie, NY (US)

(73) Assignee: Comfortex Corporation, Watervliet, NY (US)

( * ) Notice: Subject to any disclaimer, the term of this patent is extended or adjusted under 35 U.S.C. 154(b) by 0 days.

(21) Appl. No.: 10/047,143

(22) Filed: Jan. 15, 2002

(51) Int. Cl.[7] ..... A47H 5/00

(52) U.S. Cl. ..... 160/84.04; 160/168.1 R; 160/173 R; 160/177 V

(58) Field of Search ..... 160/84.01, 84.04, 160/168.1 R, 173 R, 177 V

(56) References Cited

U.S. PATENT DOCUMENTS 4,206,452 A * 6/1980 Blasucci ..... 340/548
4,413,664 A * 11/1983 Istha ..... 160/178 C
4,673,018 A * 6/1987 Judkins ..... 160/84 R
4,753,281 A * 6/1988 Wagner ..... 160/84.1
4,846,766 A * 7/1989 Glatzel ..... 474/138
4,957,152 A 9/1990 Knight et al. ..... 160/345
5,460,215 A * 10/1995 Schon ..... 160/84.06
5,535,806 A * 7/1996 Kold et al. ..... 160/273.1
5,819,679 A * 10/1998 Bonate et al. ..... 114/230
2002/0033241 A1 * 3/2002 Palmer ..... 160/170
2003/0024656 A1 * 2/2003 Ciuca ..... 160/170

* cited by examiner

*Primary Examiner*—Bruce A. Lev
(74) *Attorney, Agent, or Firm*—Rader, Fishman & Grauer, PLLC

(57) ABSTRACT

A lift cord tensioning device is provided for use with a window covering having at least one lift cord that extends downward though a shade portion from a head rail to a bottom rail. In one embodiment of the present invention, the tensioning device includes a pliable material having an aperture through which the lift cord extends. The aperture is sized to yieldably resist passage of the lift cord such that tension remains on the portion of the lift cord that resides in the head rail even when an upward directed force is applied to the bottom rail. In an alternate embodiment of the present invention, the tensioning device includes a pair of laterally offset holes through which the lift cord extends. In another alternate embodiment of the present invention, the tensioning device includes a resiliently biased gate through which the lift cord extends.

16 Claims, 3 Drawing Sheets

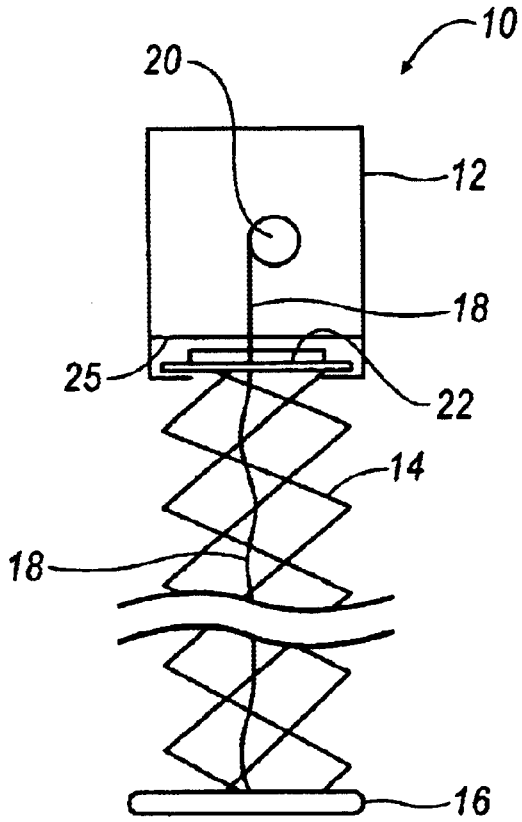
FIG. 1
FIG. 2
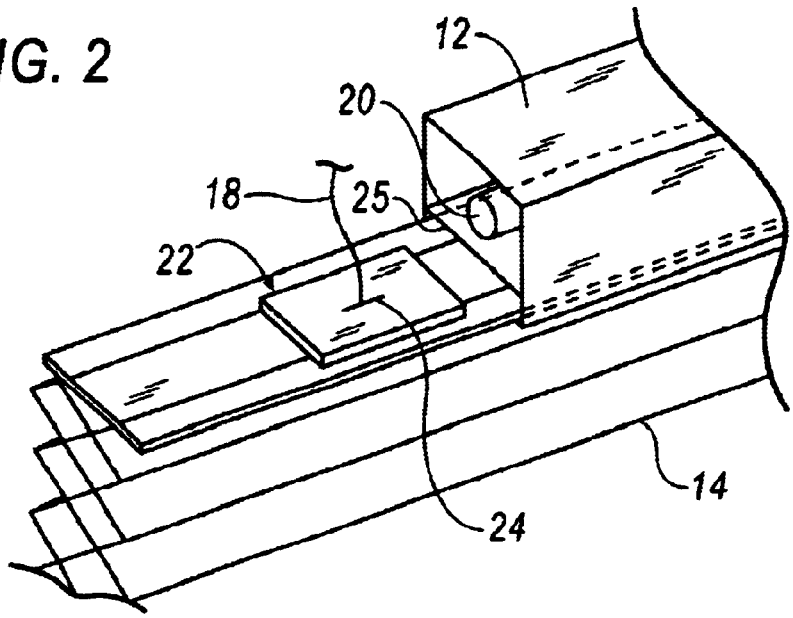

LIFT CORD TENSIONING DEVICE

BACKGROUND OF THE INVENTION

1. Field of the Invention

The present invention generally relates to window coverings and treatments. More specifically, the present invention relates to a tensioning device suitable for use in tensioning window covering lift cords.

2. Description of the Related Art

Coverings for architectural openings such as windows, doors, archways and the like take numerous forms, including conventional draperies, horizontal venetian blinds, vertical blinds, roll up shades and other coverings. The control systems utilized to operate these coverings vary depending upon the type of covering, so that a roll up shade, for example, would normally have a different control system than a vertical blind or a horizontal venetian blind. Most control systems are operated with pull cords, pull tapes, or tilt wands that hang from an end of a head rail and are manipulated by a human operator to move the covering between extended and retracted positions.

One known control system employs one or more lift cords that extend downward through the covering from the head rail to a bottom rail. The lift cords are typically wound around an axle in the head rail, which can be rotated to take-up or let-out the lift cords to extend or retract the covering. The weight of the bottom rail keeps the lift cords under tension, preventing them from tangling or looping onto themselves or other objects in the head rail. When an upward force is applied to the bottom rail, the tension in the lift cords is lost, allowing the cords to become tangled in the head rail.

Therefore, a need exists for a means to maintain tension in the portion of the lift cord that resides in the head rail, regardless of the forces applied to the bottom rail.

SUMMARY OF THE INVENTION

A lift cord tensioning device is provided for use in a window covering having at least one lift cord that extends downward though a shade portion from a head rail to a bottom rail. In one embodiment of the present invention, the tensioning device includes a pliable material having an aperture through which the lift cord extends. The aperture is sized to resist passage of the lift cord such that tension remains on the portion of the lift cord that resides in the head rail even when an upward directed force is applied to the bottom rail.

In an alternate embodiment of the present invention, the tensioning device includes a pair of holes through which the at least one lift cord extends. The holes are offset from one another a distance sufficient to resist passage of the lift cord such that tension remains on the portion of the lift cord that resides in the head rail.

In another alternate embodiment of the present invention, the tensioning device includes a moveable gate member and a fixed gate member between which the lift cord extends. The moveable gate member is biased toward the fixed gate member and into frictional contact with the lift cord. The biasing force against the moveable gate selected to yieldably resist passage of the lift cord.

The present invention allows the weight of the bottom rail to pull the lift cord down into the shade portion of the window covering, but substantially prohibits the lift cord from raising back into the head rail except through normal operation.

BRIEF DESCRIPTION OF THE DRAWINGS

FIG. 1 is a side view of an exemplary window covering employing a tensioning device according to an embodiment of the present invention;

FIG. 2 is a partial perspective view of the window covering of FIG. 1 showing the shade portion and tensioning device partially inserted into the head rail.

DESCRIPTION OF THE PREFERRED EMBODIMENT

Figure 3:
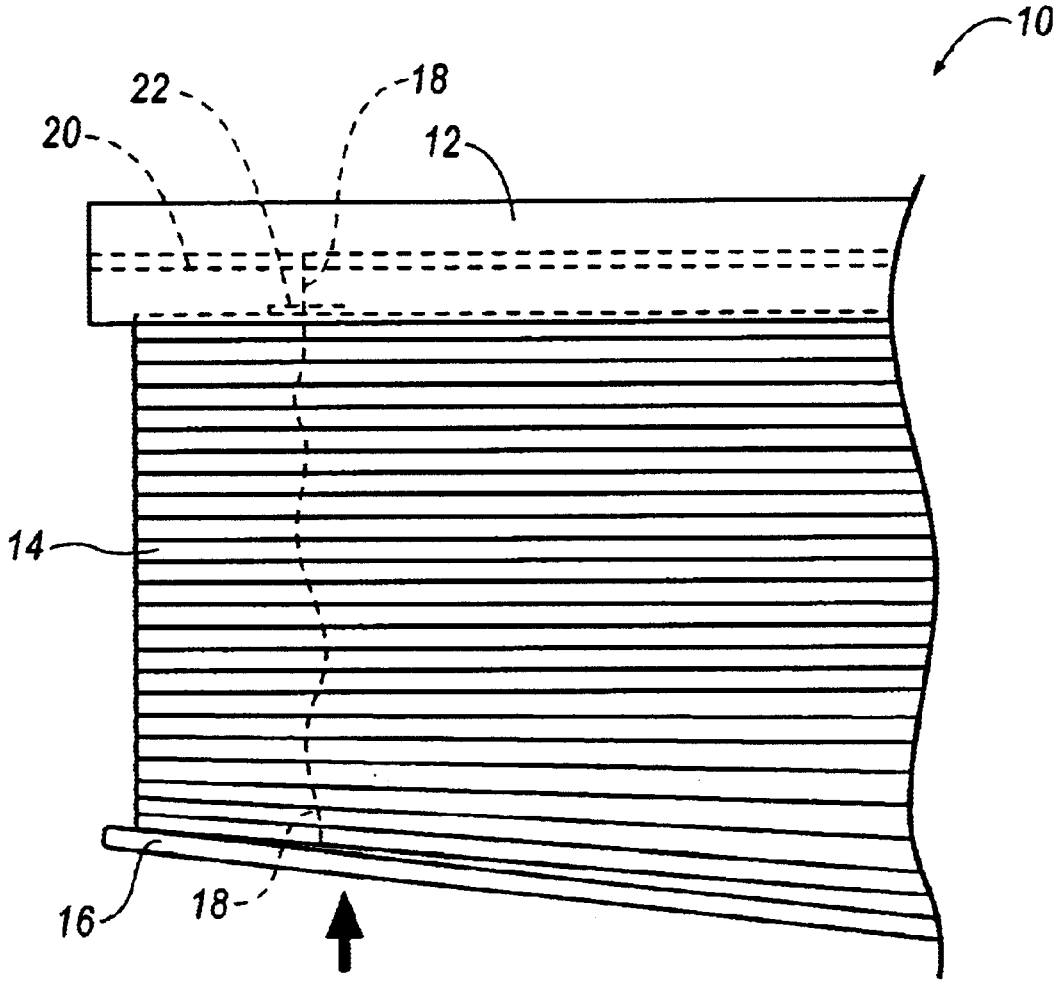
FIG. 3 is an elevational view of the window covering of FIG. 1 showing the slack and tension on the lift cord when a bottom rail of the window covering is subjected to an upwardly directed force.

Referring now to the drawings, various embodiments of the present invention are described in detail. Referring to FIG. 1, an exemplary window covering 10 is shown that generally includes a head rail 12, a shade portion 14 and a bottom rail 16. As illustrated in FIG. 1, the exemplary window covering 10 further includes at least one lift cord 18 that extends downward through shade portion 14 from head rail 12 to bottom rail 16. In the illustrated window covering design, one end of lift cord 18 is wound around an axle 20 in head rail 12 and the other end is secured to bottom rail 16. Conventional means (not illustrated) are provided to rotate axle 20 for raising and lowering shade portion 14. The structure of window covering 10 is given by way of example only, and is not intended to limit the scope of the invention as claimed. Accordingly, other window covering designs that employ one or more lift cords to extend or retract the shade portion of the window covering will fall within the scope of the present invention.

Referring still to FIG. 1, window covering 10 further includes a tensioning device 22 through which lift cord 18 extends to substantially prevent lift cord 18 from becoming tangled in head rail 12. Tensioning device 22 is preferably disposed substantially between shade portion 14 of window covering 10 and head rail 12.

Referring to FIG. 2, a first embodiment of tensioning device 22 is shown in detail. In the first embodiment, tensioning device 22 is a thin layer of pliable material, such as rubber or plastic, which includes an aperture 24 through which lift cord 18 extends. Tensioning device 22 is preferably positioned substantially in line with the path of lift cord 20 as it extends upward through shade portion 14 from bottom rail 16. Tensioning device 22 is preferably secured to shade portion 14 using a glue or similar adhesive, however the method of securement is not intended to be limited thereto. Tensioning device 22 may also be secured to an underside surface 25 of head rail 12 instead of shade portion 14.

The dimensions of aperture 24 and the material properties of the pliable material are selected so that tensioning device 22 resists passage of lift cord 18. The degree of resistance can be tailored to suit a particular window covering configuration by varying the dimensions of aperture 24 and the flexibility or resilience of the pliable material.

During normal use of window covering 10, the weight of bottom rail 16 is sufficient to maintain tension in lift cord 18. If unobstructed view of the architectural opening is desired, the resistance to lift cord passage provided by tensioning device 22 can easily be overcome, allowing shade portion 14 to be retracted. Alternatively, if coverage of the architectural opening is desired, the weight of bottom rail 16 easily overcomes the resistance to lift cord passage provided by tensioning device 22, allowing shade portion 14 to extend. However, if during extension or partial extension of shade portion 14 a force is applied to bottom rail 16, creating slack in lift cord 18, as illustrated in FIG. 3, this slack will not be transferred into head rail 22 due to the resistance provided by tensioning device 22.

Figure 4:
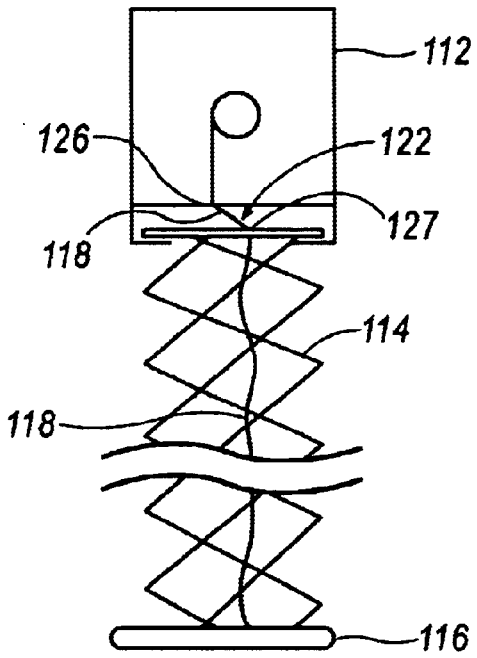
FIG. 4 is a side view of an exemplary window covering employing a tensioning device according to an alternate embodiment of the present invention.

Referring to FIG. 4, an alternate embodiment of the present invention is shown in detail. In this embodiment, a tensioning device 122 is provided that includes a pair of offset holes 126 and 127 through which a lift cord 118 extends. As illustrated in FIG. 4, hole 126 is preferably disposed in head rail 112 and hole 127 is preferably disposed in shade portion 114. The cooperating holes 126 and 127 are offset a distance sufficient to maintain tension in the portion of lift cord 118 that resides in head rail 112 even when there is slack in the portion of lift cord 118 that resides in shade portion 114.

The lateral spacing between holes 126 and 127 generally depends on various factors including, but not limited to, the weight of bottom rail 116, the width of shade portion 114, the diameter of holes 126 and 127, the diameter of lift cord 118 and the vertical spacing between holes 126 and 127. However, a lateral spacing between holes 126 on the order of approximately 5 to 10 mm is generally sufficient to maintain tension on the portion of lift cord 118 that resides within head rail 112. While tensioning device 122 is described as having a pair of offset holes 126 and 127, it will be appreciated that more than two offset holes may be used to maintain tension in lift cord 118.

Figure 5:
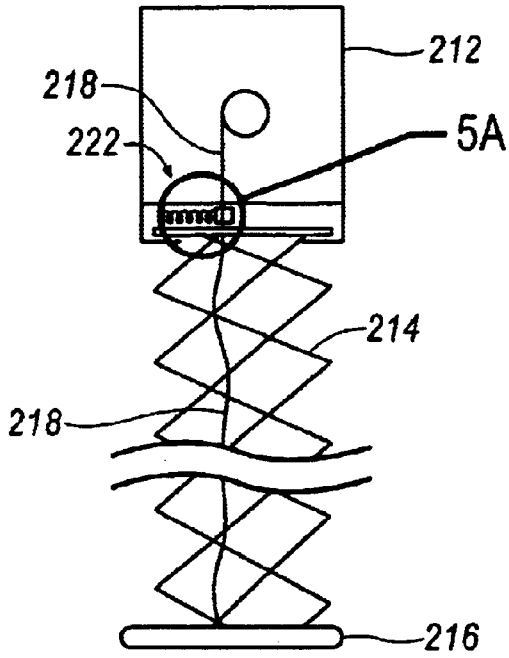
FIG. 5 is a side view of an exemplary window covering employing a tensioning device according to another alternate embodiment of the present invention.
Figure 5A:
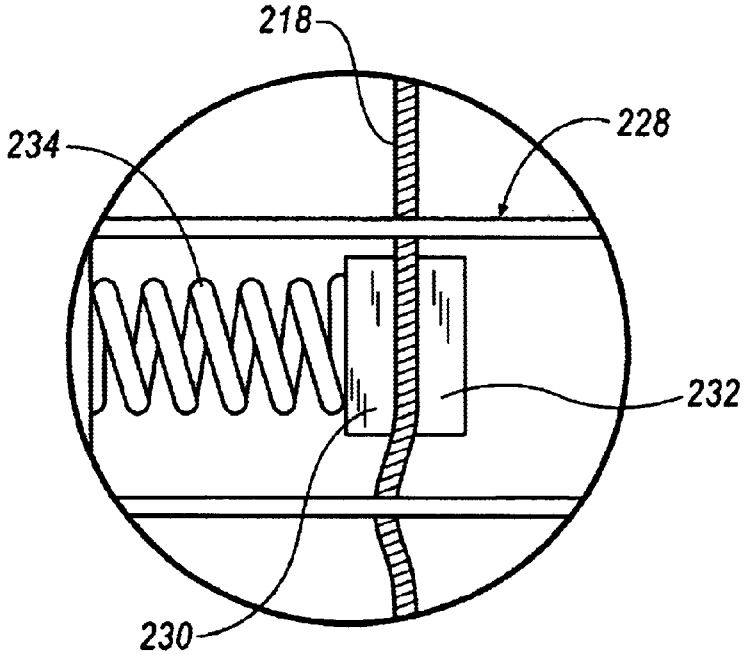
FIG. 5A is a detailed view of the tensioning device of FIG. 5.

Referring to FIG. 5, another alternate embodiment of the present invention is shown in detail. In this embodiment, a tensioning device 222 is provided that includes a resiliently biased gate 228 through which a lift cord 218 extends. As illustrated in FIG. 5A, gate 228 preferably includes a pair of opposing gate members 230 and 232 that cooperate to sandwich lift cord 218 therebetween. Movable gate member 230 is biased toward fixed gate member 232 and into frictional contact with lift cord 218 by a resilient member 234, such as a compression spring and the like. The biasing force of resilient member 234 is strong enough to prevent any slack in lift cord 218 from entering head rail 212, yet weak enough to allow the weight of bottom rail 216 to extend shade portion 214 when permitted.

As will be appreciated from the description above, the tensioning device of the present invention advantageously maintains tension in the portion of a lift cord that reside in the top rail of a window covering. This feature substantially eliminates lift cord slack in the head rail of a window covering, which prevents undesirable tangling or looping of the lift cord in the head rail.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A window covering having at least one lift cord that extends downward through a shade portion from a head rail to a bottom rail and a tensioning device, the tensioning device comprising:

a pliable material having an aperture through which the at least one lift cord extends, the aperture sized to resist passage of the at least one lift cord into the head rail when an upwardly directed force is applied to the bottom rail.

2. The window covering of claim 1, wherein the pliable material is positioned substantially between the shade portion and the head rail.

3. The window covering of claim 1, wherein the pliable material is a polymer.

4. The window covering of claim 3, wherein the pliable material is rubber.

5. The window covering of claim 1, wherein the pliable material is secured to the shade portion.

6. The window covering of claim 1, wherein the pliable material is secured to the head rail.

7. A window covering comprising:

an extendable and retractable shade portion;

a bottom rail;

at least one lift cord secured to the bottom rail and extending upward through the shade portion;

a head rail that facilitates taking-up and letting-out of the at least one lift cord; and a tensioning device through which the at least one lift cord extends, the tensioning device configured to resist passage of the at least one lift cord into the head rail when an upwardly directed force is applied to the bottom rail.

8. The window covering of claim 7, wherein the tensioning device comprises a pliable material having an aperture through which the at least one lift cord extends, the aperture sized to provide a resistance to the passage of the at least one lift cord through the pliable material.

9. The window covering of claim 8, wherein the tensioning device is positioned substantially between the shade portion and the head rail.

10. The window covering of claim 8, wherein the pliable material is rubber.

11. The window covering of claim 8, wherein the pliable material is secured to the shade portion.

12. The window covering of claim 8, wherein the pliable material is secured to the head rail.

13. The window covering of claim 7, wherein the tensioning device comprises a pair of holes through which the at least one lift cord extends, the holes laterally offset from one another a distance sufficient to resist passage of the at least one lift cord.

14. The window covering of claim 13, wherein one hole is disposed in the head rail and the other hole is disposed in the shade portion.

15. The window covering of claim 7, wherein the tensioning device comprises a moveable gate member and a fixed gate member between which the at least one lift cord extends, the moveable gate member biased toward the fixed gate member and into frictional contact with the at least one lift cord, the biasing force against the moveable gate selected to resist passage of the at least one lift cord.

16. The window covering of claim 15, wherein the tensioning device is positioned between the shade portion and the head rail.

* * * * *